US005540523A

United States Patent [19]

Foret, Jr. et al.

[11] Patent Number: 5,540,523

[45] Date of Patent: Jul. 30, 1996

[54] PILE HANDLING TOOL

[75] Inventors: Robert A. Foret, Jr., New Orleans; George Gernon, Houma, both of La.; Jesse R. Wilkins, Picayune, Miss.; Kevin P. Zaeringer, Metairie; Dale Zeringue, Houma, both of La.

[73] Assignee: McDermott International, Inc., New Orleans, La.

[21] Appl. No.: 413,145

[22] Filed: Mar. 29, 1995

[51] Int. Cl.[6] ..... E02D 7/00

[52] U.S. Cl. ..... 405/232; 405/228

[58] Field of Search ..... 405/227, 228, 405/231, 232, 245, 246, 247, 196, 197, 198; 175/51, 203

[56] References Cited

U.S. PATENT DOCUMENTS 3,495,806 10/1967 Sutton ..... 405/198

*Primary Examiner*—Tamara L. Graysay
*Assistant Examiner*—Pamela A. O'Connor
*Attorney, Agent, or Firm*—Robert J. Edwards; D. Neil LaHaye

[57] ABSTRACT

A pile handling tool for use in lowering and stabbing a pile underwater. The tool incorporates a simple release mechanism to engage or disengage the tool from the pile using an ROV. A sleeve is sized to be received over the top end of the pile. A lifting eye is provided on the top of the sleeve. A stop plate is provided in the sleeve that allows it to rest on top of the pile. A pile centralizer provided in the sleeve substantially centers the pile in the sleeve when the sleeve is lowered over the pile. Pile support pins movably received in cylinders on the sleeve are form the release mechanism and are movable by an ROV for installation of the tool and lifting and installing of a pile.

6 Claims, 1 Drawing Sheet

PILE HANDLING TOOL

BACKGROUND OF THE INVENTION

1. Field of the Invention

The invention is generally related to the installation of piles in offshore structures and more particularly to tools used for handling piles during lowering and stabbing the piles underwater.

2. General Background

Piles are used in offshore marine structures to provide a foundation for support of structures such as jackets, towers, subsea templates, and tension leg platforms. Handling and installation of piles in offshore structures utilize various tools and appurtenances for lifting the piles from transportation vessels and positioning the pile properly in the corresponding leg or sleeve. Pile handling has evolved from utilizing simple padeyes welded to each pile section to use of various devices for handling and installing piles. Pile diameters and lengths used for marine structures have increased over the years, and water depths in which piles are installed now range to three thousand feet. In deep water, pile installation usually takes place below water. In order to reduce offshore handling time and allow for remote release of piles, several types of handling tools have been developed.

One type of pile handling tool in use is a radial gripping handling tool or internal elevator. These tools use radial gripping action to hold the pile or other pipe sections. The tool is hydraulically operated and utilizes gripping segments or slips which are forced outward to engage the pile. The internal elevator can be designed to handle a range of pile diameters and pile wall thicknesses. The internal elevator requires a hydraulic line, umbilical, which is connected to a power pack on the support vessel to engage or release the slips. Other options for engaging or releasing the slips include use of a hydraulic accumulator or Remotely Operated Vehicle (ROV) hot stab mounted on the internal elevator in lieu of using an umbilical. In deeper water depths, greater than one thousand feet, history has shown that the hydraulic umbilical is susceptible to handling problems and possible breakage. Other hydraulic release mechanisms such as the ROV hot stab or hydraulic accumulator require the ROV, using its manipulator, to actuate the elevators's hydraulic system.

Another pile handling tool utilizes an interlocking lug and cam arrangement to hold the pile (quick disconnect tool). This tool is designed to fit inside the pile with plate "cams" arranged such that when the tool is lowered inside the pile, these cams mate with corresponding lugs protruding from the pile's inside walls. Two lugs are typically used in this system. The cams are designed with slots that cause the tool to rotate as it is lowered onto the pile lugs. The pile lugs engage the cams as the tool is raised and supports the pile weight. After the pile is positioned and stabbed in the designated location, the pile is lowered until it "self supports". When the tool no longer supports the pile weight, it is lowered several feet farther which causes the tool to rotate, given the cam design, allowing the lugs to slide free and thus releasing the tool. This tool usually requires special machining of the pile to achieve the proper tolerance between the pile inside diameter and the cams. Therefore, the tool must be designed and fitted to a specific pile diameter and wall thickness.

SUMMARY OF THE INVENTION

What is provided is a pile handling tool for use in lowering and stabbing a pile underwater. The tool incorporates a simple release mechanism to engage or disengage the tool from the pile using an ROV. A sleeve is sized to be received over the top end of the pile. A lifting eye(s) is provided on the top of the sleeve. A stop plate is provided in the sleeve that allows it to rest on top of the pile. Pile support pins movably received in cylinders on the sleeve are extendable between a first retracted position and a second extended position. In the first position, the pins allow the sleeve to be moved onto and off of the pile. In the second position, the pins extend through slots provided in the pile and provide support for the pile so that the tool and pile are both lifted when the tool is lifted. Drive means attached to the pins allow for manual extension and retraction or extension and retraction by a remotely operated vehicle.

BRIEF DESCRIPTION OF THE DRAWINGS

For a further understanding of the nature and objects of the present invention reference should be had to the following description, taken in conjunction with the accompanying drawing in which like parts are given like reference numerals, and wherein.

DETAILED DESCRIPTION OF THE PREFERRED EMBODIMENT

Figure 1:
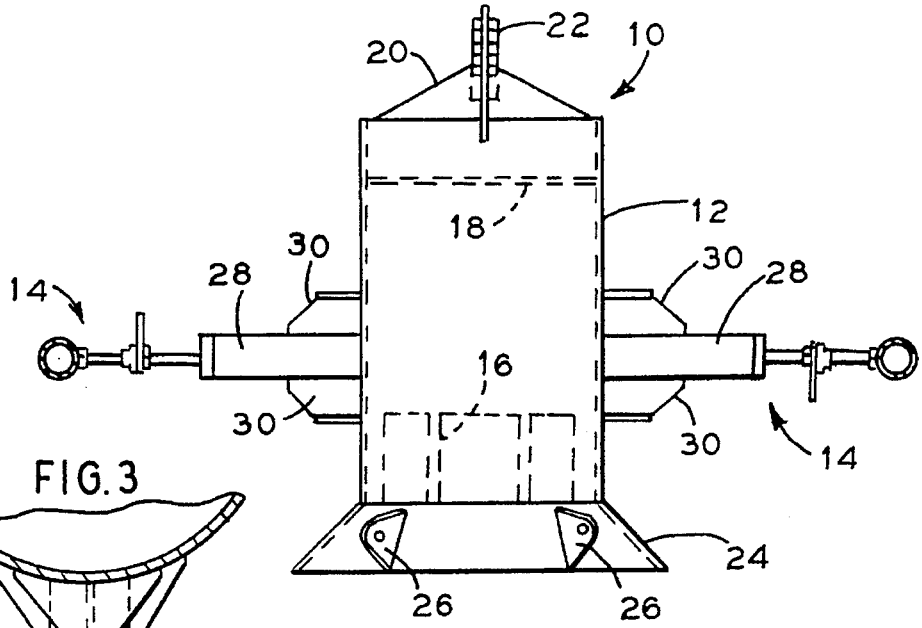
FIG. 1 is a side view of the invention.

Referring to the drawings, it is seen in FIG. 1 that the invention is generally indicated by the numeral 10. Pile handling tool 10 is generally comprised of sleeve 12, and movable pin assembly 14.

Sleeve 12 is cylindrical and is sized to have an inner diameter that is larger than the outer diameter of the pile to be installed. This results in an annular space between sleeve 12 and the pile when sleeve 12 is positioned over the pile for installation. The difference in diameter between sleeve 12 can be varied to suit any particular situation. In one embodiment of the invention, sleeve 12 has an inner diameter that is two inches larger than the outer diameter of the pile to define a one inch annulus between sleeve 12 and the pile. Plate 18 is attached across the inner diameter of sleeve 12 near its upper end. Plate 18 serves as a stop and support point for controlling the relative axial position of sleeve 12 to a pile when sleeve 12 is positioned over a pile. Radial brace 20 is rigidly attached to plate 18 and sleeve 12 and serves as an attachment point for lifting eye 22. Lifting eye 22 may be used to lift and move pile handling tool 10. Means for guiding tool 10 over a pile is provided at the lower end of sleeve 12 in the form of outwardly extending conical section 24. Conical section 24 serves as a lead-in section for guiding pile handling tool 10 over a pile during operation in the event that tool 10 is not centered exactly over the pile. Conical section 24 may also be provided with lifting means such as padeyes 26 around its upper exterior circumference that serves as attachment points for lifting and moving tool 10. Other suitable guides may be used when the extra length of conical section 24 presents potential interference problems.

Both conical section 24 and the lower interior diameter of sleeve 12 are provided with pile centralizer 16. Pile centralizer 16 can be considered essentially as being formed from steel by a narrower inner diameter at the lower end of sleeve 12. For cases where it is necessary to protect threads on pile splice fittings, pile centralizer 16 may also be formed from a plurality of ultra-high molecular weight polyethylene sheets that are attached to the inner diameter of sleeve 12 and conical section 24. The polyethylene sheets are abrasion resistant and offer low resistance to sliding of tool 10 over a pile. Each sheet is preferably approximately one-half inch thick to provide for a close fit over the pile. The close fit serves to provide a positive centering function of tool 10 over the pile.

Figure 2:
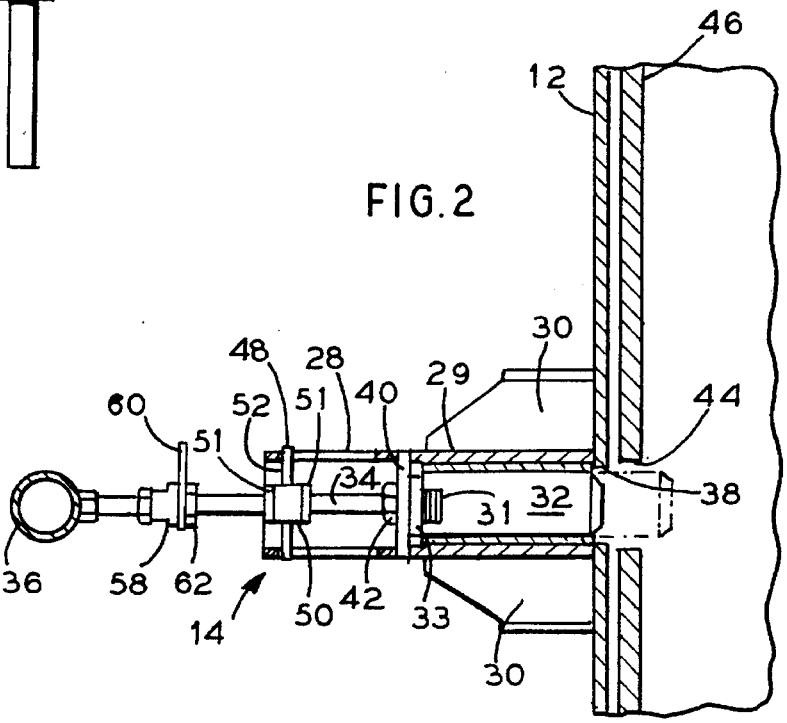
FIG. 2 is a partial cutaway side view of the invention.

As seen in FIG. 1, two movable pin assemblies, spaced one hundred eighty degrees apart around sleeve 12, are provided. For ease of reference, only one movable pin assembly will be described. As seen in FIG. 2, each movable pin assembly 14 is formed from cylinders 28 and 29, plates 30 and 40, pin 32, threaded rod 34, and drive handle 36. Cylinder 29 is rigidly attached to sleeve 12 by any suitable means such as welding and is braced by plates 30. Each cylinder is coaxially aligned with a bore 38 provided through sleeve 12. Pin 32 is slidably received in cylinder 29 and has one end attached to one end of threaded rod 34. Attachment of pin 32 to threaded rod 34 is accomplished by capturing stop plate 31 on the end of threaded rod 34 in a recess machined into the end of pin 32. Plate 33 attached to pin 32 has an oversized hole therethrough that receives threaded rod 34. Plate 40 abutting cylinder 28 has an oversized hole therethrough that receives threaded rod 34. Nut 42 is rigidly attached to plate 40 and threadably receives rod 34. In this manner, rod 34 causes extension or retraction movement of pin 32 as rod 34 is turned and threaded through nut 42 in either direction. Drive handle 36 is provided as an attachment point for a manipulator arm on a remotely operated vehicle (ROV). Drive handle 36 can also be manually turned. It can be seen from the drawings and description that each movable pin assembly 14 is designed such that pin 32 is movable between a first retracted position and a second extended position. In the first retracted position, pin 32 is retracted inside cylinder 29. In the second extended position as seen in phantom view in FIG. 2, pin 32 is extended radially inward, relative to sleeve 12, out of cylinder 29 and extends through bore 38 in sleeve 12 and through bore 44 in pile 46. It is preferable that bore 44 in pile 46 be provided in the form of a longitudinal slot that is sized to allow adequate clearance between pin 32 and pile 46 to avoid interference problems and expedite hookup and removal. The pile slots are spaced from the top of the pile such that when tool 10 is supported on the pile by plate 18, pins 32 are centered in slots 44.

Figure 3:
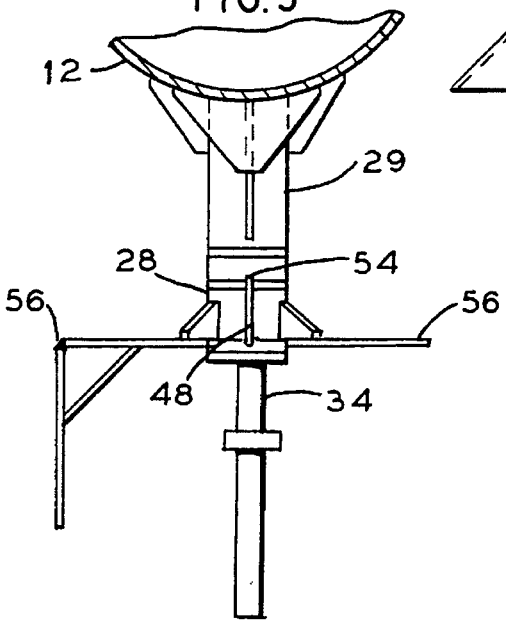
FIG. 3 is a partial top view of the invention.

An indicator 48 may be provided on rod 34 to provide a visual indication of whether pin 32 is in its first or second position. Indicator 48 is formed from a bushing 50 attached and held in position on rod 34 by plate 51 on either side of bushing 50. Indicator 48 has at least one bar 52 extending radially therefrom into a slot 54 provided in cylinder 28. Indicator 48 is illustrated in the retracted position in FIG. 3. Bushing 50 also acts as a restraint to contain extension within a desired limit by abutting against plate 40. Retraction of rod 34 is limited by plate 33 abutting against plate 40. Grab bars 56 are rigidly attached to the end of cylinder 28 farthest from sleeve 12 and serve as temporary attachment and reaction points for the ROV when it is necessary to rotate drive handle 36.

A backup release mechanism is provided in the event that the ROV is not able to rotate drive handle 36 using the manipulator arm of the ROV. A keeper pin 58 is received through a radial bore in one end of bolt 60. Bolt 60 is received through one end of drive handle 36 that fits over nut 62 rigidly attached at the end of threaded rod 34. Bolt 60 is spring loaded to cause it to move out of engagement with the end of drive handle 36 and nut 62. The ROV manipulator arm can then be used to remove drive handle 36 from nut 62. A hydraulic wrench on the ROV can then be used on nut 62 to turn threaded rod 34 with greater torque than can be applied to drive handle 36 and retract pin 32.

In operation, tool 10 is lifted, positioned over a pile 46, and lowered onto pile 46 such that pins 32 are aligned with slots 44. Drive handle 36 can then be used to manually rotate threaded rod 34 which moves each pin 32 from its first retracted position to its second extended position through bores 44 in pile 46. Tool 10 is then lifted and pins 32 engage and lift pile 46. The tool and pile are then lowered through the water and the pile is stabbed or positioned until it is self supporting in the soil. With tool 10 being supported on top of pile 46, the lift rigging is slacked and pins 32 are disengaged from pile 46 by having an ROV, using its manipulator arm, rotate drive handle 36 and rod 34 so as to move pins 32 to their first retracted position. Tool 10 is then removed from pile 46 and retrieved to the surface. The backup release mechanism is used only if necessary.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A pile handling tool for lowering and stabbing a pile underwater, comprising:

a. a sleeve having at least two bores therethrough spaced apart around said sleeve;

b. a cylinder rigidly attached to said sleeve at each bore through said sleeve and in coaxial alignment with each respective bore;

c. a pin slidably received in said cylinder and movable between a first retracted position inside said cylinder and a second extended position for engagement with the pile; and d. means engaged with said pin for selectively moving said pin between said first and second positions.

2. The tool of claim 1, further comprising means on said sleeve for substantially centering a pile in said sleeve when said sleeve is lowered over a pile.

3. The tool of claim 1, further comprising means at the bottom of said sleeve for guiding said tool over a pile.

4. The tool of claim 1, further comprising a plate attached to the interior of said sleeve adjacent one end of said sleeve and extending across the inner diameter of said sleeve.

5. A pile handling tool for lowering and stabbing a pile underwater, comprising:

a. a sleeve having at least two bores therethrough spaced apart around said sleeve;

b. means on said sleeve for substantially centering a pile in said sleeve when said sleeve is lowered over a pile;

c. a plate attached to the interior of said sleeve adjacent one end of said sleeve and extending across the inner diameter of said sleeve d. a cylinder rigidly attached to said sleeve at each bore through said sleeve and in coaxial alignment with each respective bore;

e. a pin slidably received in said cylinder and movable between a first retracted position and a second extended position; and f. means engaged with said pin for selectively moving said pin between said first and second positions.

6. The tool of claim 5, further comprising an outwardly extending conical section at the bottom of said sleeve.

* * * * *